US005458799A

United States Patent [19]

Flower

[11] Patent Number: 5,458,799

[45] Date of Patent: Oct. 17, 1995

[54] MIX PROCESS FOR FORMULATING DETERGENTS

[75] Inventor: David M. Flower, Grand Rapids, Mich.

[73] Assignee: Amway Corporation, Ada, Mich.

[21] Appl. No.: 101,587

[22] Filed: Aug. 3, 1993

[51] Int. Cl.[6] ..... C11D 7/12; C11D 1/66; C11D 1/08; C11D 7/14

[52] U.S. Cl. ..... 252/142; 252/135; 252/136; 252/174.14; 252/174.19; 252/174.21; 252/174.22; 252/174.25

[58] Field of Search ..... 252/135, 136, 252/142, 174.14, 174.19, 174.21, 174.22, 174.25

[56] References Cited

U.S. PATENT DOCUMENTS

| | | | |
|---|---|---|---|
| 3,769,222 | 10/1973 | Yurko et al. | 252/89 |
| 3,868,336 | 2/1975 | Mazzola et al. | 252/527 |
| 3,888,781 | 6/1975 | Kingry et al. | 252/99 |
| 3,956,156 | 5/1976 | Osband et al. | 252/95 |
| 3,996,149 | 12/1976 | Burke, Jr. | 252/160 |
| 4,028,262 | 6/1977 | Cheng | 252/89 R |
| 4,098,713 | 7/1978 | Jones | 252/89 |
| 4,125,475 | 11/1978 | Kolaian et al. | 252/89 R |
| 4,203,858 | 5/1980 | Chakrabarti | 252/135 |
| 4,279,766 | 7/1981 | Joubert et al. | 252/174.25 |
| 4,306,987 | 12/1981 | Kaneko | 252/99 |
| 4,352,678 | 10/1982 | Jones et al. | 51/307 |
| 4,411,810 | 10/1983 | Dutton et al. | 252/99 |
| 4,444,674 | 4/1984 | Gray | 252/95 |
| 4,473,485 | 9/1984 | Greene | 252/174.12 |
| 4,589,989 | 5/1986 | Müller et al. | 252/8.75 |
| 4,675,124 | 6/1987 | Seiter et al. | 252/91 |
| 4,726,908 | 2/1988 | Kruse et al. | 252/91 |
| 4,869,843 | 9/1989 | Saito et al. | 252/135 |
| 4,925,585 | 5/1990 | Strauss et al. | 252/89.1 |
| 4,931,203 | 6/1990 | Ahmed et al. | 252/99 |
| 4,970,017 | 11/1990 | Nakamura et al. | 252/174.13 |
| 4,992,079 | 2/1991 | Lutz | 23/313 R |

FOREIGN PATENT DOCUMENTS

| | | | |
|---|---|---|---|
| 110588 | 6/1984 | European Pat. Off. | 252/174.12 |
| 306137 | 3/1989 | European Pat. Off. . | |
| 360330 | 3/1990 | European Pat. Off. . | |

*Primary Examiner*—José G. Dees
*Assistant Examiner*—Barbara S. Frazier
*Attorney, Agent, or Firm*—Price, Heneveld, Cooper, DeWitt & Litton

[57] ABSTRACT

The present invention relates to a nonionic loaded powder detergent composition which is free-flowing and is manufactured and agglomerated in a single operation. The free-flowing agglomerated powder detergent composition is produced by mixing sodium carbonate, a di- or tricarboxylic acid and a nonionic surfactant to form a nonaqueous slurry. Water is then added to the slurry to solubilize portions of the sodium carbonate and the di- or tricarboxylic acid which allows them to react to form a builder salt in the slurry. Silica is then added to the slurry to form a flowable or nearly flowable powder detergent mixture.

28 Claims, No Drawings

MIX PROCESS FOR FORMULATING DETERGENTS

BACKGROUND OF THE INVENTION

The present invention relates to a method of making a free-flowing agglomerated powder detergent containing high levels of nonionic surfactant.

Most granular detergents are produced by spray drying. This process involves mixing detergent components such as surfactants and builders with water to form a slurry which is then sprayed into a high temperature air stream to evaporate excess water and to form bead-type hollow particles. While spray drying the detergent slurry produces a hollow granular detergent having an excellent solubility, extremely large amounts of heat energy are needed to remove the large amounts of water present in the slurry. Another disadvantage of the spray drying process is that because large scale production equipment is required, a large initial investment is necessary. Further, because the granules obtained by spray drying have a low bulk density, the granule packaging volume is large which increases costs and paper waste. Also, the flowability and appearance of the granules obtained by spray drying is poor because of the presence of large irregularities on the surface of the granules.

In addition to these characteristic processing and product problems associated with the spray drying process, volatile materials, such as nonionic surfactants, are emitted into the air when processed by this method with the other detergent components. This volatilization problem, manifested by the discharge of dense "blue" smoke from the spray tower, is referred to as "plumbing." Air pollution standards limit the opacity of the plume. Consequently, it is necessary to limit the capacity of the spray tower or, in extreme instances, discontinue operation.

Other suggested methods call for post-dosing the product with nonionic surfactant after the spray drying operation. Unfortunately, post-dosing of the spray dried base with surfactant in amounts sufficient to provide satisfactory wash performance generally results in poor flowing, aesthetically displeasing products. Accordingly, the amount of surfactant that may be employed in the detergent formulation is severely limited. Because heavy-duty laundry detergents need large amounts of nonionic surfactant present, inorganic silicates have been added to these detergent formulations to absorb the nonionic liquids.

U.S. Pat. No. 3,769,222 to Yurko et al. discloses mixing liquid nonionic surfactants with sodium carbonate until partial solidification occurs followed by the addition of large amounts of silica (silicon dioxide) to produce a dry free-flowing detergent composition. A disadvantage to this technique, however, is that because the silica has no significant cleaning activity, its inclusion in a detergent formulation in large amounts merely serves to increase the cost of the product. Further, the use of silica in detergents adds to the total suspended solids (TSS) content of laundry waste water contrary to the dictates of many local and state water pollution standards. Therefore, there is an incentive to keep low the amount of silica added to the detergent composition.

U.S. Pat. No. 4,473,485 to Greene reports that a free-flowing granular detergent can be prepared by mixing a polycarboxylic structuring agent solution with a micronized sodium carbonate as a builder and a flow agent, followed by the addition to the mixture of a nonionic surfactant and water, followed by removal of the excess water. A disadvantage of this process, however, is that the removal of excess water from the detergent powder requires additional processing time and generally requires the consumption of heat energy. Another significant disadvantage of this process is that the micronized sodium carbonate used by Greene to enhance the flowability of the detergent product is quite expensive as compared to standard sodium carbonate. Without the use of the micronized sodium carbonate, Greene's product would not have such good flowability.

While various attempts have been made to produce granular detergent compositions by methods other than spray drying, these methods have not alleviated all of the problems completely. For example, some methods contemplate the addition of binders to agglomerate the powder particles. Typically, premixed ingredients are tumbled in a large drum while binder solution is sprayed onto the tumbling particles. These methods suffer from the problems of wide particle size distribution of the resulting particles and poor water solubility.

In both spray drying processes and agglomeration processes, ingredients must first be mixed and then treated in a separate operation to effect granulation, i.e., either a spray drying operation or an agglomerating operation. Therefore, there is a need to find a new method for producing a highly loaded nonionic detergent composition having enhanced flowability, product appearance, water solubility and water dispersibility while minimizing the attendant fire, air and water pollution hazards as well as the foregoing processing disadvantages.

SUMMARY OF THE INVENTION

In the present invention, a free-flowing, high bulk density, granulated powder detergent composition is produced by mixing sodium carbonate, a di- or tricarboxylic acid or its corresponding salt, and a nonionic surfactant to form a nonaqueous slurry. Water is added to the slurry for dispersal of the ingredients and to agglomerate the sodium carbonate with the di- or tri-carboxylic acid or its salt. Silica is then added to the agglomerated mixture to form a flowable or nearly flowable powder detergent mixture.

DETAILED DESCRIPTION OF THE PREFERRED EMBODIMENT

In the preferred embodiment, from about 30 to about 55% by weight sodium carbonate, based on final product weight, is blended with from about 15 to about 25 % by weight nonionic surfactant, based on final product weight, from about 2 to about 10% by weight of a di- or tricarboxylic acid (hereinafter referred to as "acid"), based on final product weight, and from about 15 to about 30% by weight of the corresponding salt to the acid, based on final product weight, to form a nonaqueous slurry. Additional ingredients in an aqueous solution, providing from about 1 to about 5 % by weight water, based on final product weight, are then added to the nonaqueous slurry.

The addition of the water causes the granulation of the surfactant loaded soda ash particles with the acid and/or acid salt particles. Highly absorbent silica is then added to the agglomerated mixture to recover a flowable or nearly flowable high bulk density agglomerated powder detergent. The resulting detergent has advantageously been produced without the need for a separate granulating step or special equipment.

Among the preferred synthetic sodium carbonates used in the following examples are light density (LT) soda ash (Solvay process), mixtures of light density (LT) and medium density soda ash (Sesquicarbonate process), a special high porosity "medium-light" ash (Sesquicarbonate process) and contain mixtures of light density and "medium-light" ash. These particles of sodium carbonate have a density of from about 0.5 to about 0.7 and a mesh size ranging from about 20 to about 200, U.S. Standard Sieve number. Carbonates such as these are commercially available from FMC Corp. and Allied Chemical and are relatively inexpensive as compared to more processed carbonates because they do not require further processing such as grinding.

The sodium carbonate can be present in the free-flowing detergent composition in the amount of about 30% to about 55% by weight of the final product. The amount of sodium carbonate added to the final product is balanced against the amount of nonionic surfactant which will be loaded into the sodium carbonate as well as the amount which will be neutralized by the acid which will be present in the detergent composition. The more preferred range for the sodium carbonate is about 35% to about 45% by weight of the final product.

In an alternative embodiment, the total sodium carbonate content desired for the product is divided into a first portion and a second portion. Initially, the first portion of sodium carbonate is mixed with the nonionic surfactant, the acid and acid salt to form the nonaqueous slurry. Following the addition of the water to this slurry silica is blended into the mixture to recover the product to a flowable or nearly flowable powder detergent. The second portion of sodium carbonate is then added to the recovered detergent to form a free-flowing high bulk density powder detergent.

In this alternative embodiment, the amount of sodium carbonate in the first portion must be sufficient to hold the amount of nonionic surfactant loaded into the detergent composition. The first portion of sodium carbonate of the free-flowing detergent composition must be present in the amount of about 15% to about 35% by weight of the final product. The more preferred range for the first portion of the sodium carbonate is about 15% to about 25%. Of course, with the choice of the amount of the first portion of the sodium carbonate, the amount of the second portion of the sodium carbonate is already determined.

Among the di- and tricarboxylic acids which can be incorporated into the free-flowing detergent composition are citric acid, maleic acid, malic acid, tartaric acid and succinic acid. Citric acid is the most preferred carboxylic acid because it is relatively inexpensive and is readily obtainable. The chosen acid is used in the process at from about 0% to about 12% by weight of the final product. The preferred range of the acids is from about 2% to about 10% by weight of the final product and the most preferred range is from about 3% to about 7%.

Acid levels which are too high can result in lower alkalinity by neutralization of sodium carbonate which can detrimentally affect detergent performance. Too little acid, on the other hand, reduces the ability of the acid salt hydrate to entrap the moisture flora aqueous liquid streams and hampers granulation. Weak granulation of the free-flowing detergent composition can be obtained, however, solely through the addition of the sodium salt of the above-indicated acids if, when the percentage of organic acid in the composition is 0%, there is at least about 5% of the salt. For example, it has been found that tile substitution of sodium citrate in an amount of about by weight of tile final product for the citric acid in the slurry produces a weakly granulated product. The resulting product, however, is wetter and does not have the same flowability as product where citric acid is used. Minimally, a total of 5% salt and acid is preferred, when the acid is less than 3% by weight of final product.

The nonionic surfactant is preferably liquid at normal processing temperatures, i.e., at temperatures from about 25 to about 50° C. Suitable nonionic surfactant compounds fall into several different chemical types. These are generally polyoxyethylene or polyoxypropylene condensates of organic compounds having reactive hydrogen atoms. Illustrative, but not limiting, examples of suitable nonionic compounds are:

(a) polyoxyethylene or polyoxypropylene condensates of aliphatic carboxylic acids, whether linear- or branched-chain and unsaturated or saturated, containing from about 8 to about 18 carbon atoms in the aliphatic chain and incorporating from 5 to about 50 ethylene oxide or propylene oxide units. Suitable carboxylic acids include "coconut" fatty acid (derived from coconut oil) which contains an average of about 12 carbon atoms, "tallow" fatty acids (derived from tallow-class fats) which contain an average of about 18 carbon atoms, palmitic acid, myristic acid, stearic acid and lauric acid;

(b) polyoxyethylene or polyoxypropylene condensates of alipatic alcohols, whether linear- or branched-chain and unsaturated or saturated, containing from about 8 to about 24 carbon atoms and incorporating from about 5 to about 50 ethylene oxide or propylene oxide units. Suitable alcohols include the "coconut" fatty alcohol (derived from coconut oil), "tallow" fatty alcohol (derived from the tallow-class fats), lauryl alcohol, myristyl alcohol, and oleyl alcohol.

Particularly preferred nonionic surfactant compounds in this category are the "Neodol" type products, a registered trademark of the Shell Chemical Company. Neodol 23–6.5 and Neodol 25–3 which are, respectively, $C_{12-13}$ and $C_{12-15}$ linear primary alcohol ethoxylates formed from 6.5 and 3 moles of ethylene oxide, respectively, have been found very useful in the present invention. Neodol 45–13, a $C_{14-15}$ linear primary alcohol ethoxylate, has also been found effective in the present invention. Another preferred nonionic surfactant is a group of compounds sold under the registered trademark of "Tergitol 15-S" manufactured by the Union Carbide Company. The "Tergitol 15-S" materials are mixtures of $C_{11-15}$ secondary alcohol condensed with 9–14 molar proportions of ethylene oxide.

The nonionic surfactants can be present in the free-flowing detergent composition in the amount of about 15% to about 25% by weight of the final product. Of course, the detergent benefits of high nonionic concentration must be balanced against cost-performance. Therefore, the more preferred range for the nonionic surfactants is about 16% to about 22% by weight of the final product.

The amount of water added to the nonaqueous slurry is minimal. From about 1% to about 5% water by weight of the final product is required. Preferably, about 2.5% water by weight of the final product is added to the nonaqueous slurry. Incorporation of water at these levels obviates the necessity of a drying step. Energy costs and time are thereby saved. Additional ingredients such as polyacrylate and organic phosphonates are often dissolved in the water prior to addition to the nonaqueous solution.

The amount of silica added to the frothing slurry is from about 0.5% to about 4% by weight of the final product. Preferably, about 2.0% silica by weight of the final product is added to frothing slurry. A variety of siliceous substances are acceptable for addition to the detergent composition, although highly absorbant silica of the precipitated or fumed variety is preferred. The preferred siliceous compounds have oil absorption numbers of 150 to about 350 or greater, preferably about 250 or greater. As examples of operable silicas, the following siliceous materials are representative: Sipernat 50, Syloid 266, Cabosil M-5, Hisil 7–600.

Other typical detergent ingredients may also be used in the preferred embodiment. Peroxy-bleach agents along with their activators, suds-controlling agents and suds-boosters may be included. Minor ingredients such as anti-tarnishing agents, dyes, buffers, perfumes, anti-redeposition agents, colorants, and fluorescers may be included. Most additional ingredients are preferably added in solution with the small amount of water added to the nonaqueous slurry. However, post addition, after addition of the high absorbant silica, is also an option.

The mixing steps in the process to prepare detergent compositions of this invention can be accomplished with a variety of mixers known in the art. For example, simple, paddle or ribbon mixers are quite effective although other mixers, such as drum agglomerators, fluidized beds, pan agglomerators and high shear mixers may be used. Generally, the mixing temperature can range around 20° C. to about 50 C. A temperature rise in the batch due to heat of reaction and mixing may at times necessitate a cooling mechanism. Batch temperatures higher than about 50° C. appear to adversely affect the product characteristics and are, therefore, undesirable.

An advantage of the present process over previously disclosed detergent processing methods is that relatively inexpensive, commercially available, standard ingredients are used. For example, there is no need to use micropulverized sodium carbonate; standard size sodium carbonate is preferred. Because the present process avoids a drying step and uses standard ingredients, it allows the rapid production of an inexpensive free-flowing granular powder detergent having high nonionic surfactant levels and a relatively high bulk density.

With reference to Table I, Examples 1–12 and 14–18 prepared a granular powder detergent in a one-step process in accordance with this invention. Specifically, a first portion of sodium carbonate was dry mixed with citric acid and nonionic surfactant was added to the dry mix to form a nonaqueous slurry. After thorough mixing, a cobuilder salt solution of polyacrylate (PA) and organic phosphate (Dequest) was poured into the nonaqueous slurry. This addition of water to the slurry caused the granulation of the sodium carbonate with the cirtic acid via an in situ neutralization reaction. The addition of silica to the mixture allowed the recovery of a wet powder or dough. The second portion of sodium carbonate was then added to complete the drying of the wet powder or dough to form a freely flowable granular concentrated detergent powder. A post-dose of sodium citrate, along with other ingredients such as TAED, perborate and enzymes, was then added to complete the detergent formulation. The resulting detergent formulations had bulk densities of greater than 0.7 and were prepared in a single mixer rather than requiring the transfer of the formulation to a drum or other agglomerator and then to a dryer for drying the formulation.

With reference to Table I, Example 13 prepared a free-flowing granular powder detergent in a one-step process. Specifically, a first portion of sodium carbonate was dry mixed with sodium citrate and nonionic surfactant was added to the dry mix to form a nonaqueous slurry. After thorough mixing, a co-builder salt solution of polyacrylate (PA) and organic phosphonate (Dequest®) was poured into the nonaqueous slurry. This addition of water to the slurry caused a weak granulation of the sodium carbonate with the sodiron citrate. The addition of silica to the mixture allowed the recovery of a wet powder or dough. The second portion of sodium carbonate was then added to complete the drying of the wet powder or dough to form a freely flowable concentrated detergent powder. A post-dose of additional sodium citrate, along with other ingredients such as TAED perborate and enzymes, was then added to complete the detergent formulation. The resulting detergent formulations had bulk densities of greater than 0.7 and were prepared in a single mixer rather than requiring the transfer of the formulation to a drug agglomerator and/or to a dryer for drying the formulation.

The powder detergents prepared in Examples 1–18 have a high bulk density, they also contain a high level of liquid nonionic surfactant, are free-flowing, non-caking and non-bleeding, and are prepared in a simple batch process without additional drying or conditioning steps.

Producing a detergent composition with a high bulk density is preferred because the consumer needs to use less volume of the product to obtain the same cleaning power as compared to a detergent composition with a lower bulk density. Further, because the consumer needs less volume of detergent per load, the manufacturer can reduce the size of the packaging for the detergent composition while maintaining the same number of washes per box, thus reducing the amount of paper and packaging material entering the waste stream.

The following examples are for illustrative purposes only and are not to be construed as limiting the invention. Unless otherwise indicated, all percentages are by weight on a final weight basis.

SINGLE STEP AGGLOMERATED BATCHES
ALL PERCENTAGES BASED ON FINAL PRODUCT WEIGHT

| Examples | % First Portion Soda Ash | % Citric Acid | % Surfactant | % Liquids PolyAc, Dequest, $H_2O$ | Silica | % Second Portion Soda Ash | Post Dose % Sod. Citrate | Bulk Density |
|---|---|---|---|---|---|---|---|---|
| 1 | 20 LT | 5.00 | 20.00 | 2.0 PA, 3.0 D | 2.0% | 20 LT | 20.00 | 0.741 |
| 2 | 20 LT | 5.00 | 20.00 | 2.0 PA, 3.0 D | 2.0% | 20 LT | 15.00 | 0.724 |
| 3 | 20 LT | 5.00 | 20.00 | 2.0 PA, 3.0 D | 2.0% | 20 G90 | 15.00 | 0.767 |
| 4 | 20 G90 | 5.00 | 20.00 | 2.0 PA, 2.0 D | 2.0% | 20 G90 | 15.00 | 0.745 |
| 5 | 10 LT/10 G90 | 5.00 | 20.00 | 2.0 PA, 2.0 D | 2.0% | 20 G90 | 15.00 | 0.759 |
| 6 | 20 LT | 8.00 | 20.00 | 2.0 PA, 2.0 D | 2.0% | 20 G90 | 12.00 | 0.710 |
| 7 | 20 LT | 5.00 | 20.00 | 2.0 PA, 2.0 0 | 2.0% | 20 R-322 | 15.00 | 0.726 |
| 8 | 15 LT | 5.00 | 20.00 | 2.0 PA, 2.0 D | 2.0% | 25 G90 | 15.00 | 0.759 |

-continued

SINGLE STEP AGGLOMERATED BATCHES
ALL PERCENTAGES BASED ON FINAL PRODUCT WEIGHT

| Examples | % First Portion Soda Ash | % Citric Acid | % Surfactant | % Liquids PolyAc, Dequest, $H_2O$ | Silica | % Second Portion Soda Ash | Post Dose % Sod. Citrate | Bulk Density |
|---|---|---|---|---|---|---|---|---|
| 9 | 12 LT | 8.00 | 20.00 | 2.0 PA, 2.0 D | 2.0% | 28 G90 | 12.00 | 0.734 |
| 10 | 15 LT | 5.00 | 20.00 | 2.0 PA, 2.0 D | 2.0% | 22 G90 | 15.00 | 0.746 |
| 11 | 15 LT | 5.00 | 20.00 | 2.0 PA, 2.0 D | 2.0% | 25 G90 | 15.00 | 0.757 |
| 12 | 15 LT | 5.00 | 20.00 | 2.0 PA, 2.0 D | 2.0% | 25 G90 | 15.00 | 0.773 |
| 13 | 15 LT | 0.00 | 20.00 | 2.0 PA, 2.0 D | 2.0% | 25 G90 | 15.00 | 0.780 |
| 14 | 15 LT | 5.00 | 16.00 | 2.0 PA, 2.0 D | 2.0% | 26 G90 | 15.00 | 0.788 |
| 15 | 15 LT | 5.00 | 20.00 | 2.0 PA, 2.0 D | 2.0% | 25 G90 | 15.00 | 0.726 |
| 16 | 15 LT | 5.00 | 16.00 | 2.0 PA, 2.0 D | 2.0% | 26 R-322 | 15.00 | 0.795 |
| 17 | 15 LT | 5.00 | 20.00 | 2.5 $H_2O$ | 2.0% | 25 G90 | 15.00 | 0.770 |
| 18 | 20 LT | 5.00 | 20.00 | 2.0 D | 2.0% | 20 G90 | 15.00 | 0.770 |

The foregoing is merely a preferred embodiment of the invention and various changes and alterations will be apparent to those of ordinary skill in the art.

The embodiments of the invention in which an exclusive property or privilege is claimed are defined as follows:

1. A process for manufacturing a free-flowing powder detergent composition comprising:

providing sodium carbonate present in about 30% to about 55% by weight of the final product; providing a nonionic surfactant present in about 15% to about 25% by weight of the final product, said nonionic surfactant being liquid at temperatures of from about 250° C. to about 50° C.; providing an organic acid present in about 0% to about 12% by weight of the final product, except that said percentage cannot be 0% unless there is at least about 5% of its corresponding salt present, cannot be less than 1% unless there is at least about 2.5% of said salt present, and must be at least 2% if there is none of said salt present, said organic acid selected from the group consisting of di- and tricarboxylic acids; providing a sodium salt of said organic acid present in about 0% to about 8% by weight of the final product; providing silica present in about 0.5% to about 4.0% by weight of the final product;

mixing said sodium carbonate with said organic acid, said salt of said organic acid and said nonionic surfactant to form a nonaqueous slurry;

adding from about 1% to about 5% by weight of the final product water to said slurry; and stirring said silica into said slurry to form a flowable granulated powder detergent composition.

2. A process in accordance with claim 1 wherein said sodium carbonate is present in about 35% to about 45% by weight of the final product.

3. A process in accordance with claim 2 wherein said nonionic surfactant is present in about 16% to about 22% by weight of the final product.

4. A process in accordance with claim 3 wherein said organic acid is present in about 2% to about 10% by weight of the final product.

5. A process in accordance with claim 4 wherein said water is present in about 1% to about 3% by weight of the final product.

6. A process in accordance with claim 5 wherein said silica is present in about 1% to about 3% by weight of the final product.

7. A process in accordance with claim 3 wherein said organic acid is present in about 3% to about 7% by weight of the final product.

8. A process in accordance with claim 7 wherein said water is present in about 1% to about 3% by weight of the final product.

9. A process in accordance with claim 8 wherein said silica is present in about 1% to about 3% by weight of the final product.

10. A process in accordance with claim 1 wherein said water is present in about 1% to about 3% by weight of the final product.

11. A process in accordance with claim 10 wherein said silica is present in about 1% to about 3% by weight of the final product.

12. A process in accordance with claim 11 wherein said organic acid is citric acid.

13. A process in accordance with claim 1 wherein said salt of said organic acid is present in about 5% by weight of the final product.

14. A process for manufacturing a free-flowing agglomerated powder detergent composition comprising:

providing a first portion of sodium carbonate present in about 15% to about 35% by weight of the final product; providing a nonionic surfactant present in about 15% to about 25% by weight of the final product, said nonionic surfactant being liquid at temperatures of from about 250° C. to about 500° C.; providing an organic acid present in about 0% to about 12% by weight of the final product, said organic acid selected from tile group consisting of di- and tricarboxylic acids, except that said percentage cannot be 0% unless there is at least about 5% of its corresponding salt present, cannot be less than 1% unless there is at least about 2.5% of said salt present, and must be at least 2% if there is none of said salt present, providing a sodium salt of said organic acid present in about 0% to about 8% by weight of the final product; providing silica present in about 0.5% to about 4% by weight of the final product; and providing a second portion of sodium carbonate present in about 5% to about 40% by weight of the final product, to a total sodium carbonate content of from about 30 to about 55% by weight of tile final product;

mixing said first portion of sodium carbonate with said organic acid, said salt of said organic acid and said nonionic surfactant to form a nonaqueous slurry;

adding from about 1% to about 5% by weight (of the final product) water to said slurry;

stirring said silica into said slurry to form a flowable or nearly flowable powder detergent mixture; and combining said detergent mixture with said second carbonate portion to form a free-flowing agglomerated powder detergent composition.

15. A process in accordance with claim 14 wherein said first portion of sodium carbonate is present in about 15% to about 25% by weight of the final product.

16. A process in accordance with claim 15 wherein said nonionic surfactant is present in about 16% to about 22% by weight of the final product.

17. A process in accordance with claim 16 wherein said organic acid is present in about 2% to about 10% by weight of the final product.

18. A process in accordance with claim 17 wherein said water is present in about 1% to about 3% by weight of the final product.

19. A process in accordance with claim 18 wherein said silica is present in about 1% to about 3% by weight of the final product.

20. A process in accordance with claim 19 wherein said second portion of sodium carbonate is present in about 15% to about 30% by weight of the final product.

21. A process in accordance with claim 16 wherein said organic acid is present in about 3% to about 7% by weight of the final product.

22. A process in accordance with claim 21 wherein said water is present in about 1% to about 3% by weight of the final product.

23. A process in accordance with claim 22 wherein said silica is present in about 1% to about 3% by weight of the final product.

24. A process in accordance with claim 14 wherein said water is present in about 1% to about 3% by weight of the final product.

25. A process in accordance with claim 24 wherein said silica is present in about 1% to about 3% by weight of the final product.

26. A process in accordance with claim 25 wherein said second portion of sodium carbonate is present in about 15% to about 30% by weight of the final product.

27. A process in accordance with claim 26 wherein said organic acid is citric acid.

28. A process in accordance with claim 14 wherein said salt of said organic acid is present in about 5% by weight of the final product.

* * * * *

UNITED STATES PATENT AND TRADEMARK OFFICE

CERTIFICATE OF CORRECTION

PATENT NO. : 5,458,799
DATED : October 17, 1995
INVENTOR(S) : David M. Flower

It is certified that error appears in the above-indentified patent and that said Letters Patent is hereby corrected as shown below:

Column 3, line 58;
"flora" should be --from--.

Column 3, line 64;
"tile" should be --the--.

Column 3, line 65;
After "about" insert --5%-- and "tile" should be --the--.

Column 4, line 24;
"alipatic" should be --aliphatic--.

Column 5, line 23;
"50 C." should be --50° C.--.

Column 5, line 47;
"cirtic" should be --citric--.

Column 6, line 20;
"sodiron" should be --sodium--.

Column 7, line 30;
"250° C." should be --25° C.--.

Column 8, line 44;
"250° C. to about 500° C." should be --25° C. to about 50° C.--.

UNITED STATES PATENT AND TRADEMARK OFFICE

CERTIFICATE OF CORRECTION

PATENT NO. : 5,458,799

DATED : October 17, 1995

INVENTOR(S) : david M. Flower

It is certified that error appears in the above-indentified patent and that said Letters Patent is hereby corrected as shown below:

Column 8, line 46;
"tile group" should be --the group--.

Column 8, line 59;
"tile final" should be --the final--.

Signed and Sealed this

Fourth Day of June, 1996

Bruce Lehman

*Attest:*

BRUCE LEHMAN

*Attesting Officer*

*Commissioner of Patents and Trademarks*